United States Patent [19]

Rosado

[11] Patent Number: 4,729,226

[45] Date of Patent: Mar. 8, 1988

[54] PROCESS FOR MECHANICAL POWER GENERATION

[76] Inventor: Serafin M. Rosado, Marques de Lozoya, 15, Madrid, Spain

[21] Appl. No.: 816,143

[22] Filed: Jan. 3, 1986

[30] Foreign Application Priority Data

Oct. 1, 1985 [ES] Spain ..... 539.465

[51] Int. Cl.[4] ..... F01K 25/04; F01K 25/06; F01K 25/08

[52] U.S. Cl. ..... 60/649; 60/651; 60/655; 60/671

[58] Field of Search ..... 60/655, 649, 671, 651

[56] References Cited

U.S. PATENT DOCUMENTS

| | | | |
|---|---|---|---|
| 709,115 | 9/1902 | Rosenthal | 60/671 |
| 3,266,246 | 8/1966 | Heller et al. | 60/655 |
| 3,557,554 | 1/1971 | Martinek et al. | 60/671 |

*Primary Examiner*—Michael Koczo
*Attorney, Agent, or Firm*—Ostrolenk, Faber, Gerb & Soffen

[57] ABSTRACT

A process of mechanical power generation including a binary cycle whose primary cycle works with a mixture of water and another substance of much lower volatility substantially immiscible with water. In the primary cycle, at least part of the vaporization of the water is accomplished by means of the heat yielded simultaneously by condensation at variable temperature of the substance of high boiling point. This binary cycle allows obtaining much higher efficiencies than conventional cycles in small power plants (up to 50 MWe), thanks to the diminishing energy losses in the heat absorption, optmising the expansion efficiencies with simple turbines and substantially eliminating the vacuum in the installation. The proposed cycle has better partial load efficiency and lower response time than conventional cycles, with similar cost.

13 Claims, 3 Drawing Figures

BASIC SKETCH OF THE PROPOSED CYCLE

SKETCH OF THE CYCLE WITH WATER AND DIPHENYLOXIDE

DIAGRAM t-ΔH FOR THE CYCLE OF FIG. 2 WITH T MAXIMUM = 400°C

PROCESS FOR MECHANICAL POWER GENERATION

BACKGROUND OF THE INVENTION

The excellent gross electrical efficiency of large conventional thermoelectric power plants, as well as the current tendency to further enlarge these plants, is well known.

At the same time and for specific applications, especially in the highly industrialized countries, a trend exists towards the construction of small plants with power below 50 MW. Plants of this type, using conventional thermodynamic cycles, generally use renewable energies, municipal wastes or waste heat, and are characterized by their low efficiency.

OBJECTS AND SUMMARY OF THE INVENTION

Proposed herein is a new thermodynamic cycle, characterized by high design point efficiency and high partial load efficiency, high functional stability, simple construction and relatively low cost.

The main applications of this process are in the field of energy sources with temperatures greater than 400° C., utilizing solar energy, municipal wastes, biomass, as well as industrial heat effluents. This process is also appropriate for heat recovery at variable temperatures and below 400° C., for example, diesel engine waste heat. The process is also useful for industrial applications, e.g. total-energy plants and for urban district heating.

In order to obtain high efficiencies in relation to the Carnot Cycle, operating at high maximum temperatures and in low-power installations, which conventional cycles fail to achieve, a cycle with the following characteristics was sought:

1. Good adaptation of the heat absorption curve of the cycle to the cession curve of external heat sources with high minimum temperature, in order to keep low the exergy losses through heat transmission between the external heat source and the cycle.

2. Expansion or expansions in a turbine with optimum thermodynamic conditions in order to be able to use simple turbines (single stage, if possible) with high isoentropic efficiency, both at the design point and at partial load. For this, it is necessary to operate with fluids of high molecular weight, with moderate maximum pressures and with low pressure ratios to permit a high degree of reaction and dry expansion.

3. Absence of vacuum in the installation in order to eliminate the energy losses in this context and to be able to condense at the minimum temperature that the cooling medium permits, or even with variable condensing temperatures in accord with the time of the year.

A cycle of the foregoing characteristics can not be achieved by operating with a single fluid. From studies carried out, it has been deduced that, working with maximum temperatures of the order of 400° C. (to obtain a high absolute efficiency), it is necessary to use at least three cycles, each with a single fluid, coupled in cascade, in order to achieve the above-mentioned objectives. Each of the three cycles would operate with a different fluid whose boiling point would be adapted to the temperature range assigned to said cycle. Water could not be one of the fluids, since, operating as the intermediate cycle, it could fulfill the first and the third conditions above, but not the second, because of its low molecular weight.

This solution has the inconvenience of demanding an extra heat exchanger surface for heat recovery (particularly because the fluids of high molecular weight and dry expansion imply recovering considerable heat at the turbine outlet) and needing three cycles and three turbines, with the consequent operational complexity and effect on the costs.

The proposed invention herein relates to substituting for the two single-fluid cycles which would operate in high and intermediate temperature range, a single cycle which operates with a mixture of two immiscible fluids with notably different boiling points, while maintaining the single-fluid cycle which operates in the low temperature range. The reason for keeping this last cycle separate is the unavailability of refrigerant fluids appropriate for use at the low temperature range which have a high molecular weight and can withstand temperatures of the order of 400° C.

Compared with the above-described ternary cycle, this binary cycle is less complex to operate, i.e. its operation is similar to that of a conventional cycle having a single fluid, since the secondary cycle of refrigerant fluid may be a standard compact unit, which starts up, operates and stops automatically and independently according to the energy it receives from the primary cycle.

Working with a mixture of two fluids offers the advantage that, although the fluids used must have suitable boiling points for the temperature range that each of them covers, the condition of having high molecular weight need not be met separately by each of them, but it is sufficient if it is fulfilled by the mixture which expands in the turbine. In this way, water can be used as the fluid of the lowest boiling point in the mixture, provided that the other fluid has a high molecular weight. This offers the advantage of being able to use steam seals in the turbines without contaminating the working fluid.

Compared with the two independent cycles (those that have been substituted for) in the cited ternary cycle, the cycle with the fluid mixture also offers another advantage, which is to reduce the circulating fluid masses and, above all, to drastically reduce the heat exchange surface necessary, not only because it has fewer heat exchanges but also because these take place, in great part, with condensations and vaporizations (eutectic at constant temperature and non-eutectic at variable temperature) instead of with superheated vapor.

The basic plan of the proposed cycle is shown in FIG. 1. In particular, the primary cycle comprises:

(a) dry expanding of the dry vapor mixture from the maximum working pressure and temperature to the minimum working pressure, to produce an expanded vapor mixture;

(b) cooling the expanded vapor mixture and then condensing at variable temperatures part of the substance of the higher boiling point, the heat yielded by said condensation being recovered by the primary cycle (in step (e) below);

(c) separating the part of the substance of higher boiling point which has condensed in (b), and pumping the condensed liquid to a point of equivalent temperature in step (e);

(d) total condensing the vapor mixture remaining after (c) in a heat exchanger which transfers heat from the primary to the secondary cycle, first at variable temperatures until it reaches the eutectic composition and then at the eutectic temperature corresponding to the minimum working pressure of the primary cycle;

(e) recovering the heat ceded in operation (b) for heating the mixture condensed in operation (d) and for partially vaporizing it;

(f) absorbing heat by the mixture in two phases obtained from operation (e), the mixture vaporizing totally until reaching the maximum working temperature of the primary cycle, to return to operation (a).

Depending on the mass ratio of the two substances in the mixture of the primary cycle, the ratio between the heat recovered in the cycle itself and the heat absorbed from an external heat source varies notably. In this way, the cycle can adapt to the temperature curve of the heat source.

The practical execution of the heat recovery and the heat absorption from the external heat source varies depending on the mass ratio to be used.

DETAILED DESCRIPTION OF A PARTICULAR CASE OF THE INVENTION

In the following practical example, the primary cycle works with a mixture of water and diphenyl oxide and the secondary cycle with FREON R11.

Figure 1:
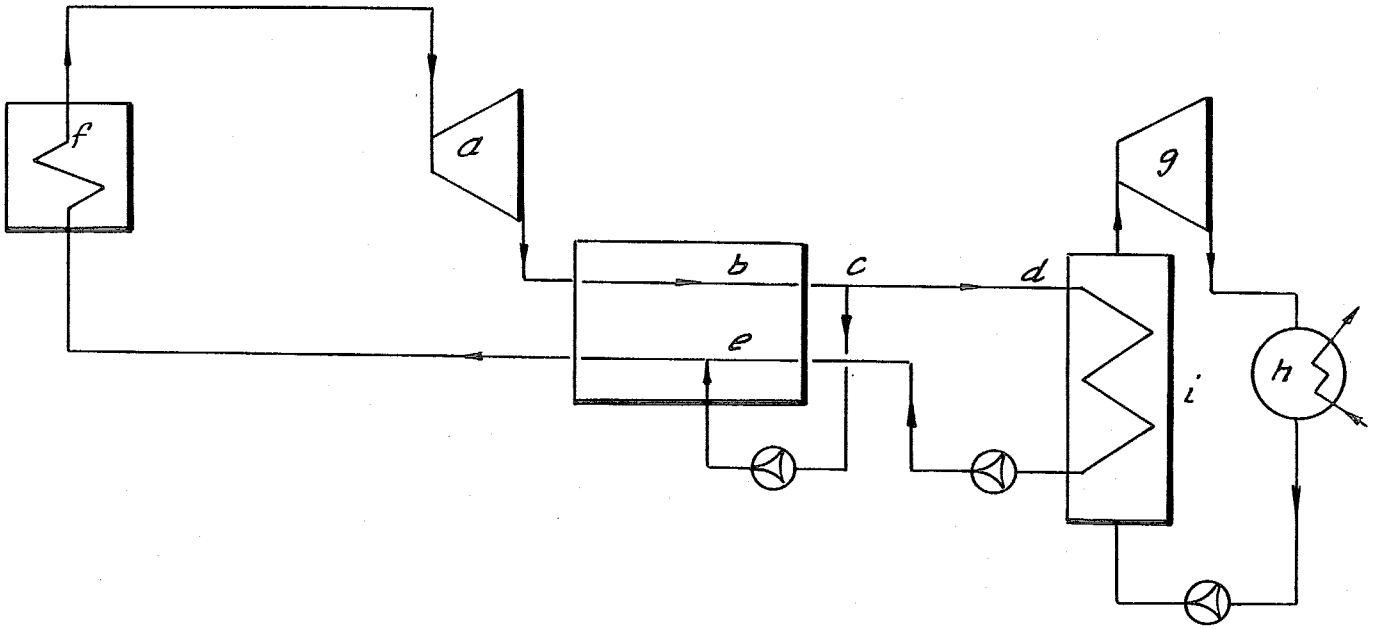
FIG. 1 is a schematic of the cycle of this invention.
Figure 2:
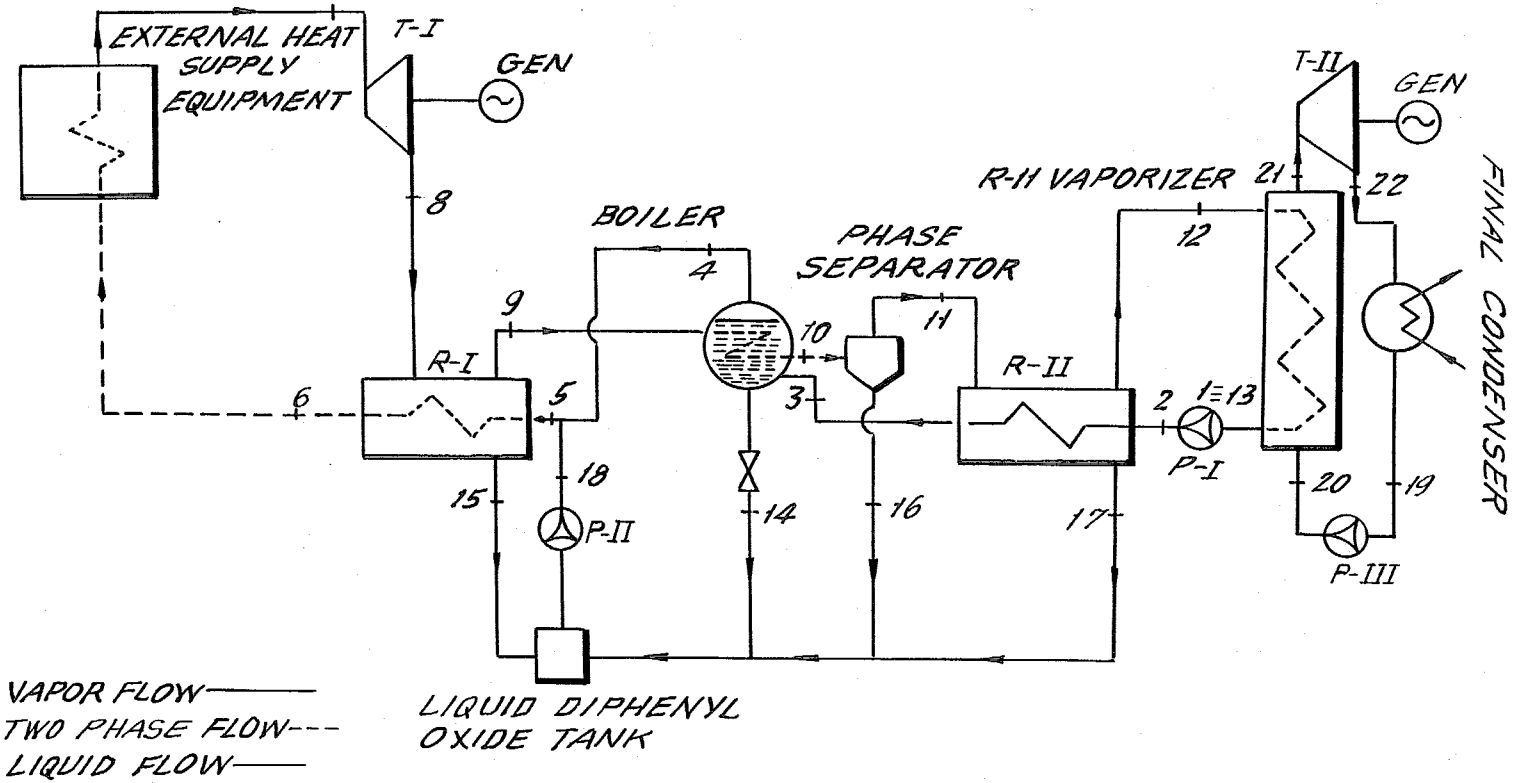
FIG. 2 is a schematic of the cycle of this invention using water and diphenyl oxide.
Figure 3:
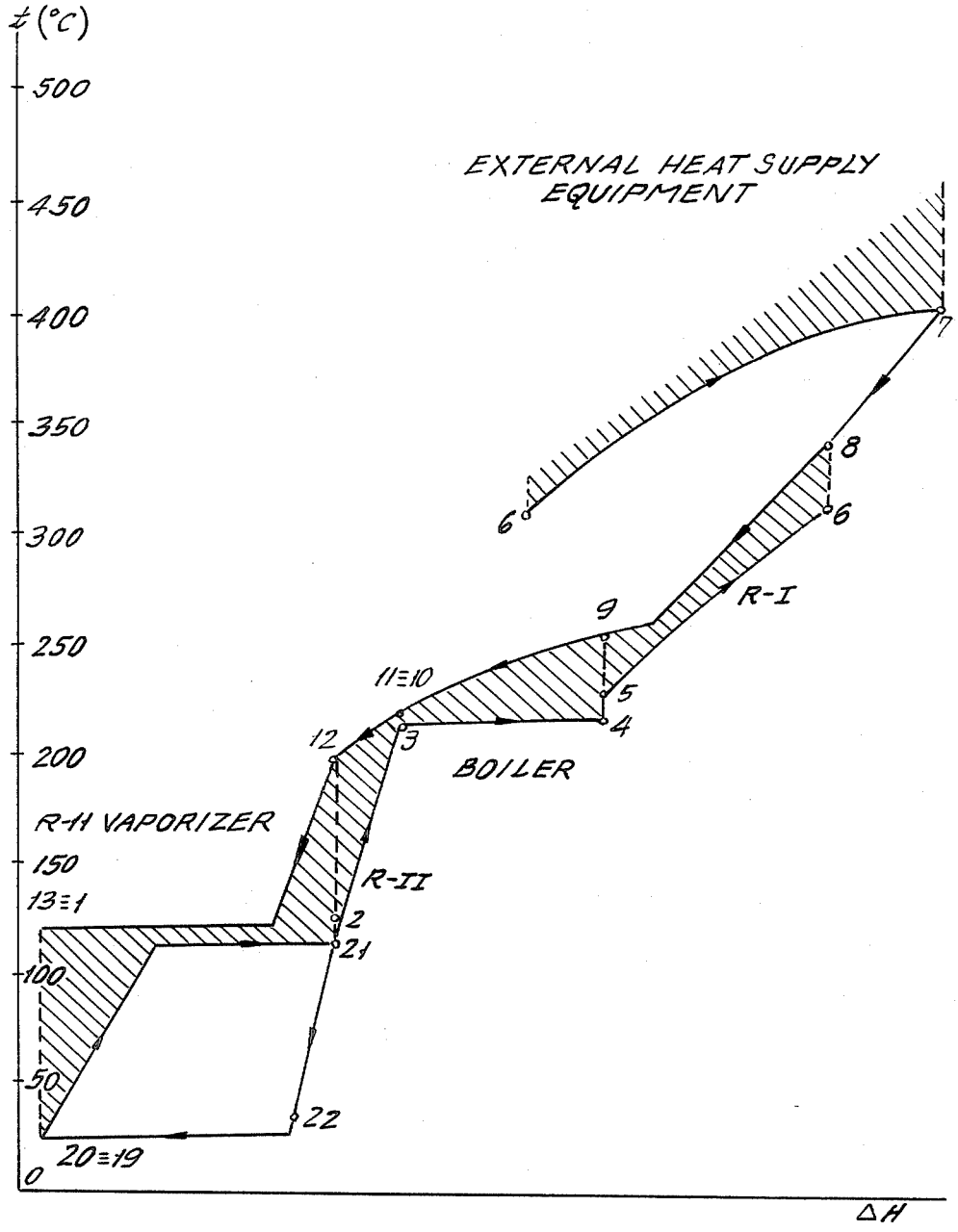
FIG. 3 is a plot of t-ΔH for the cycle of FIG. 2 with a maximum temperature of 400° C.

FIG. 2 is an embodiment for recovering energy from sources with a constant or variable temperature whose minimum temperature would be relatively high.

The cycle includes two turbines (T-I and T-II), external heat supply equipment, two recuperators (R-I and R-II), a kettle boiler, an R11 vaporizer, a condenser, a phase separator and three pumps (P-I, P-II and P-III). In this case, the two recuperators and the kettle carry out the heat recovery of the primary cycle. The process works in the following manner:

Mixtures of liquids, diphenyl oxide and water (point 1) coming from the R11 vaporizer, is pumped (P-I) to the maximum process pressure and is introduced (point 2) into the pipes of the recuperator (R-II).

The heated liquid mixture (point 3) is then introduced into the boiler shell. In this, the water vaporizes together with a small proportion of diphenyl oxide, generating a eutectic mixture of vapors (point 4) at the eutectic temperature for the maximum process pressure. The remaining liquid diphenyl oxide is extracted from the bottom of the kettle shell, where it accumulates due to its greater density, and is sent to the diphenyl oxide vessel (point 14).

Before entering the recuperator (R-I) pipes (point 5), the eutectic mixture of vapors generated in the kettle (point 4) is mixed with the liquid diphenyl oxide pumped by P-II at the maximum process pressure (Point 18). This liquid diphenyl oxide has been collected in a vessel from various points of the cycle (14, 15, 16 and 17), as can be seen in FIG. 2.

In the R-I recuperator pipes, a non-eutectic vaporization of liquid diphenyl oxide takes place. This vaporization is at variable temperature, in such a way that at each point of the transformation, the temperature is the saturation temperature of diphenyl oxide for the partial pressure of this in the non-eutectic mixture of diphenyl oxide vapor and steam, which accompanies the liquid diphenyl oxide through the pipes. At the outlet of the R-I recuperator pipes (point 6) there is still an important amount of liquid diphenyl oxide together with a non-eutectic mixture of diphenyl oxide vapor and steam.

This stream, which is in two phases then passes to the external heat supply equipment where, again at variable temperature, the liquid diphenyl oxide is vaporized. At the outlet (point 7), all the liquid diphenyl oxide has vaporized, obtaining a mixture of diphenyl oxide vapor and steam, which is dry and saturated in diphenyl oxide (it could also be superheated). In the case of this example, for a determined maximum temperature, the maximum cycle pressure determines the proportions of diphenyl oxide vapor and steam at point 7, because, as the mixture is saturated in diphenyl oxide, the partial pressure of this must be that of saturation of the diphenyl oxide at the maximum cycle temperature.

The vapor mixture generated in the external heat supply equipment enters the turbine (T-I) where it expands to a suitable pressure for the subsequent heat recovery stage. The mixture expands, superheating, due to the strong tendency that the most abundant component (diphenyl oxide) has. Accordingly, the expansion is completely dry.

The superheated vapor mixture exhausted from the turbine (point 8) passes to the hot side of the successive heat exchangers of the heat recovery stage, whose cold side has been described above. Firstly, it passes to the R-I recuperator shell where it cools until reaching the dew point of the mixture at the existing pressure. From this point, the condensation of diphenyl oxide begins, at variable temperature, for the same reason as in the case of the vaporization therein.

At the R-I recuperator outlet, there exists liquid diphenyl oxide which has condensed and a remaining vapor mixture saturated in diphenyl oxide. The condensed liquid diphenyl oxide (point 15) is drained into the liquid diphenyl oxide vessel. The vapor mixture (point 9) passes to the boiler pipes.

In the boiler pipes, the diphenyl oxide continues condensing at variable temperatures. At the outlet, a phase separator collects the liquid diphenyl oxide, which is drained into the liquid diphenyl oxide vessel (point 16). The remaining vapor mixture (point 11), saturated in diphenyl oxide, passes to the R-II shell, where, again at variable temperature, a part of diphenyl oxide condenses, to be extracted at the R-II recuperator outlet (point 17) and carried to the liquid diphenyl oxide vessel. The remaining vapor mixture (point 12), saturated in diphenyl oxide, goes to the refrigerant fluid (R11) vaporizer.

In the R11 vaporizer, the vapor mixture condenses in the following manner: firstly, a portion of the diphenyl oxide condenses, until the vapor mixture reaches its eutectic composition at practically the same temperature as that of saturation of the water at the given pressure. Then, diphenyl oxide and water condenses simultaneously, until it becomes the liquid mixture at the beginning of the description of the cycle (point 1).

In the secondary cycle, the refrigerant fluid, vaporized in the shell zone of the R11 vaporizer (point 21), passes to the turbine T-II to dry expand, superheating, to the saturating pressure for the fixed condensing temperature (point 22). This pressure is equal or slightly higher than the atmospheric pressure. From there it passes to the final condenser (point 19) to temper and condense and finally it is pumped to the vaporizer by P-III, at the maximum pressure of this cycle (point 20). By using a refrigerant fluid with a greater tendency to superheat in the expansion, or by superheating the refrigerant fluid with the heat absorbed from the primary cycle, the liquid could be preheated by the desuperheating of the vapor exhausted by the turbine, which would augment the efficiency of the secondary cycle.

What is claimed is:

1. A process of mechanical power generation using a binary cycle having a primary cycle and a secondary cycle, wherein the primary cycle employs a mixture of water and a second substance which is substantially immiscible with water and has substantially lower volatility than water, comprising in the primary cycle:

(a) dry expanding of a dry vapor mixture from a maximum working pressure and temperature to a minimum working pressure, to produce an expanded vapor mixture;

(b) cooling the expanded vapor mixture and then condensing at variable temperatures part of the substance of the higher boiling point, the heat yielded by said condensation being recovered by the primary cycle in step (e);

(c) separating the part of the substance of higher boiling point which has condensed in step (b), and pumping said condensed part to a point of equivalent temperature in step (e);

(d) total condensing the vapor mixture remaining after step (c) in a heat exchanger which transfers heat from the primary to the secondary cycle, first at variable temperatures until it reaches the eutectic composition and then at the eutectic temperature corresponding to the minimum working pressure of the primary cycle;

(e) recovering the heat ceded in step (b) for heating the mixture condensed in step (d) and for partially vaporizing it;

(f) absorbing heat by the mixture in two phases obtained from step (e), the mixture vaporizing totally until reaching the maximum working temperature of the primary cycle, to return to step (a).

2. The process of mechanical power generation of claim 1, wherein heat recovery of the primary cycle consists of three substages, characterized by the medium which operates in the cold side: in the first substage, that of the lowest temperature, the mixture in liquid phase is heated; in the second substage, all the substance of the lower boiling point, in eutectic mixture with part of the substance of higher boiling point, vaporizes at the eutectic temperature, said substance of lower boiling point being water; and in the third substage, part of the remaining fluid of higher boiling point vaporizes non-eutectically at variable temperature.

3. The process of mechanical power generation of claim 2, wherein the parts of the substance of higher boiling point condensed in the hot side of each recovery substage of the primary cycle, are separated and later pumped to one or various suitable points in the cold side of the heat recovery, which can be the inlet, outlet or any intermediate point between substages.

4. The process of mechanical power generation of claim 2, wherein the vaporization of the second heat recovery substage of the primary cycle takes place in the shell of a heat exchanger (kettle type or another), the surplus substance of higher boiling point being separated in the bottom part.

5. The process of mechanical power generation of claim 2, wherein the vaporization of the second substage is not eutectic, but rather only the water, previously separated in liquid phase from the other substance, vaporizes.

6. The process of mechanical power generation of claim 2, wherein the non-eutectic vaporization of the substance of higher boiling point of the primary cycle, in the third substage, does not take place directly in a heat exchanger but rather by means of a mixture of the substance of higher boiling point in liquid phase, previously heated in said third substage, either with the eutectic vapor mixture generated in the second substage or with the saturated steam generated in said second substage.

7. The process of mechanical power generation of claim 2, wherein the third substage of heat recovery of the primary cycle is eliminated.

8. The process of mechanical power generation of claim 2, wherein the vaporization of the water or the eutectic vaporization of the mixture in the second substage of the primary cycle, is not complete but rather a part of it is carried out by an external heat source.

9. The process of mechanical power generation of claim 2, wherein the heating of the liquid mixture of the primary cycle in the first substage is not complete but rather a part or the totality of it is carried out by an external heat source.

10. The process of mechanical power generation of claim 1, wherein the secondary cycle not only absorbs heat from the primary cycle but also from the external heat source.

11. The process of mechanical power generation of claim 1, wherein the substance of lower volatility is a eutectic mixture of diphenyl and diphenyl oxide, which mixture behaves practically as a pure substance, due to the total miscibility in liquid phase and the great proximity of the saturation curves of these two substances.

12. The process of mechanical power generation of claim 1, wherein the secondary cycle operates with water.

13. The process of mechanical power generation of claim 12, wherein instead of generating pure steam in the secondary cycle, the remaining vapor mixture after operation (c), formed mostly by steam, is used to directly expand, generating work in a turbine or similar equipment, the exhaust mixture going to the final condenser.

* * * * *